US006688126B1

(12) United States Patent
Kim et al.

(10) Patent No.: US 6,688,126 B1
(45) Date of Patent: Feb. 10, 2004

(54) BUILT-IN REFRIGERATOR

(75) Inventors: Kyung Sik Kim, Inchon-kwangyokshi (KR); Tae Hee Lee, Seoul (KR); Yang Gyu Kim, Seoul (KR); Eui Yeop Chung, Taegu-kwangyokshi (KR); Se Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/309,161

(22) Filed: Dec. 4, 2002

(30) Foreign Application Priority Data

Jul. 24, 2002 (KR) ..... P2002-43603

(51) Int. Cl.[7] ..... F25D 23/12
(52) U.S. Cl. ..... 62/258; 62/259.1
(58) Field of Search ..... 62/258, 259.1, 62/440, 428, 508

(56) References Cited

U.S. PATENT DOCUMENTS 2,708,350 A * 5/1955 Earle ..... 62/277
3,462,966 A * 8/1969 Reid et al. ..... 62/248
3,650,122 A * 3/1972 Lieberman ..... 62/298
3,651,660 A * 3/1972 Quiros ..... 62/279
3,926,486 A * 12/1975 Sasnett ..... 312/198
4,424,686 A * 1/1984 Lapeyre et al. ..... 62/259.1
4,723,631 A * 2/1988 Tremblay ..... 182/161
4,907,419 A * 3/1990 Kruck et al. ..... 62/263
5,368,486 A * 11/1994 Kurzman ..... 434/79
5,918,474 A * 7/1999 Khanpara et al. ..... 62/179
6,282,914 B1 * 9/2001 Steinhoff et al. ..... 62/302
6,532,757 B2 * 3/2003 Holzer et al. ..... 62/331

FOREIGN PATENT DOCUMENTS

JP 404319310 A * 11/1992 ..... 312/107

OTHER PUBLICATIONS

Pub. No.: US 2003/0005716 A1 Wall mounted refrigerator system, Jul. 3, 2001, Applicant—Michael Doran.*
Pub. No.: US 2003/0029178 A1—Refrigerator quich chill and thaw control methods and apparatus, Jan. 5, 2001 ,Applicant Zenter et al.*

* cited by examiner

*Primary Examiner*—William E. Tapolcai
*Assistant Examiner*—Mohammad M. Ali
(74) *Attorney, Agent, or Firm*—Fleshner & Kim, LLP

(57) ABSTRACT

A built-in refrigerator is disclosed. The built-in refrigerator includes: a main body installed in a sink and having a door at a front side thereof and a machine room at a rear lower side thereof; condenser and compressor respectively installed in the machine room; a cooling fan installed in the machine room, for cooling the condenser and the compressor; and a radiation passage allowing an outside of a front side of the main body to communicate with the machine room to introduce external air into the machine room and discharge internal air of the machine room.

18 Claims, 3 Drawing Sheets

BUILT-IN REFRIGERATOR

This application claims the benefit of the Korean Application No. P2002-43603 filed on Jul. 24, 2002, which is hereby incorporated by reference.

BACKGROUND OF THE INVENTION

1. Field of the Invention

The present invention relates to a built-in refrigerator.

2. Discussion of the Related Art

Generally, the refrigerator is an apparatus used for taking storage of foods freshly for a long-term period, and is generally divided into the main body with the food storage room and the machine room for taking storage of foods in frozen and cold storage states, and a cooling cycle for cooling the food storage room.

Here, the main component of the cooling cycle includes the compressor, the condenser, the evaporator and the expansion valve. Generally, the compressor and the condenser are installed within the machine room equipped at the rear lower side of the main body, and the evaporator and the expansion valve are installed adjacent to the food storage room. The food storage room of the main body is cooled through the following sequence.

First, the compressor is driven by the electromotor to compress coolant in gas state and to transfer the compressed coolant to the condenser, and the coolant of the condenser is liquefied by blowing air using the cooling fan. The flow rate of the coolant in liquid state is adjusted at the expansion valve and thus the coolant rapidly expands and is evaporated with being injected into the evaporator. At this time, the coolant absorbs heat from the periphery of the evaporator to thereby cool the food storage room. The coolant in gas state returns to the compressor, is compressed at the compressor to be converted into the liquid state, and again repeats the aforementioned condensation, expansion, evaporation, and compression cycles.

Meanwhile, since the above-constituted refrigerator is generally installed at one sidewall of kitchen or living room, it is protruded by its size from the wall to badly affect on beauty on appearance, and there is also caused a drawback in that practical space use is lowered.

To this end, in these days, there is being requested the development of the built-in refrigerator which a part of the body thereof enters into the wall in or can be installed at the sink. Among these built-in refrigerators, there is being more strongly requested the built-in refrigerator which is installed at the sink which provides a convenience of use upon cooking of foods and is the most preferred space by housewives.

Then, in case a refrigerator is installed in the sink, air flow is blocked owing to the characteristic of the built-in refrigerator, so that there is focused a radiation technology for effectively radiating the heat generated from the condenser and the compressor installed within the machine room provided at the rear lower side of the main body.

SUMMARY OF THE INVENTION

Accordingly, the present invention is directed to a built-in refrigerator that substantially obviates one or more problems due to limitations and disadvantages of the related art.

An object of the present invention is to provide a built-in refrigerator, which can be installed at a sink to enhance practical space use of a kitchen or a living room and to enhance the beauty on appearance.

Another object of the present invention is to provide a built-in refrigerator with a superior radiation performance of the machine room.

A further object of the present invention is to provide a built-in refrigerator in which there is no need of installation of a hot line for eliminating condensed water forming on the periphery of the door and thus fabrication costs are very low.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a built-in refrigerator includes: a main body installed in a sink and having a door at a front side thereof and a machine room at a rear lower side thereof; condenser and compressor respectively installed in the machine room; a cooling fan installed in the machine room, for cooling the condenser and the compressor; and a radiation passage allowing an outside of a front side of the main body to communicate with the machine room to introduce external air into the machine room and discharge internal air of the machine room.

Here, it is preferable that the condenser and the compressor are respectively installed at both sides of the machine room, and the cooling fan is one pair installed at a center of the machine room to face with each other. The respective cooling fans may be axially coupled to different motors, or be axially coupled to both sides of a single motor.

It is preferable that the radiation passage is formed by securing a spacing between a lower side of the main body and an indoor bottom face, and the built-in refrigerator further includes a dividing strip which divides the radiation passage into an inflow passage through which external air is introduced and an outflow passage through which internal air is discharged. Here, the dividing trip is installed such that the inflow passage is formed at a center of the radiation passage and the outflow passage is formed at both sides of the inflow passage. More preferably, the dividing strip is installed such that the inflow passage is located between introducing sides of the cooling fan and the outflow passage is located at a discharging side of the cooling fan. Further, the outflow passage is formed extending to a lower side of a periphery of the door of the main body.

Also, the built-in refrigerator further includes a floorcloth stay on the bottom of the indoor room located at a front lower side of the main body. Here, it is preferable that a predetermined spacing secured between an upper side of the floorcloth stay and the lower side of the main body forms a part of the radiation passage, and the floorcloth stay is formed integrally to be connected with a floorcloth stay of other portion of the sink It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
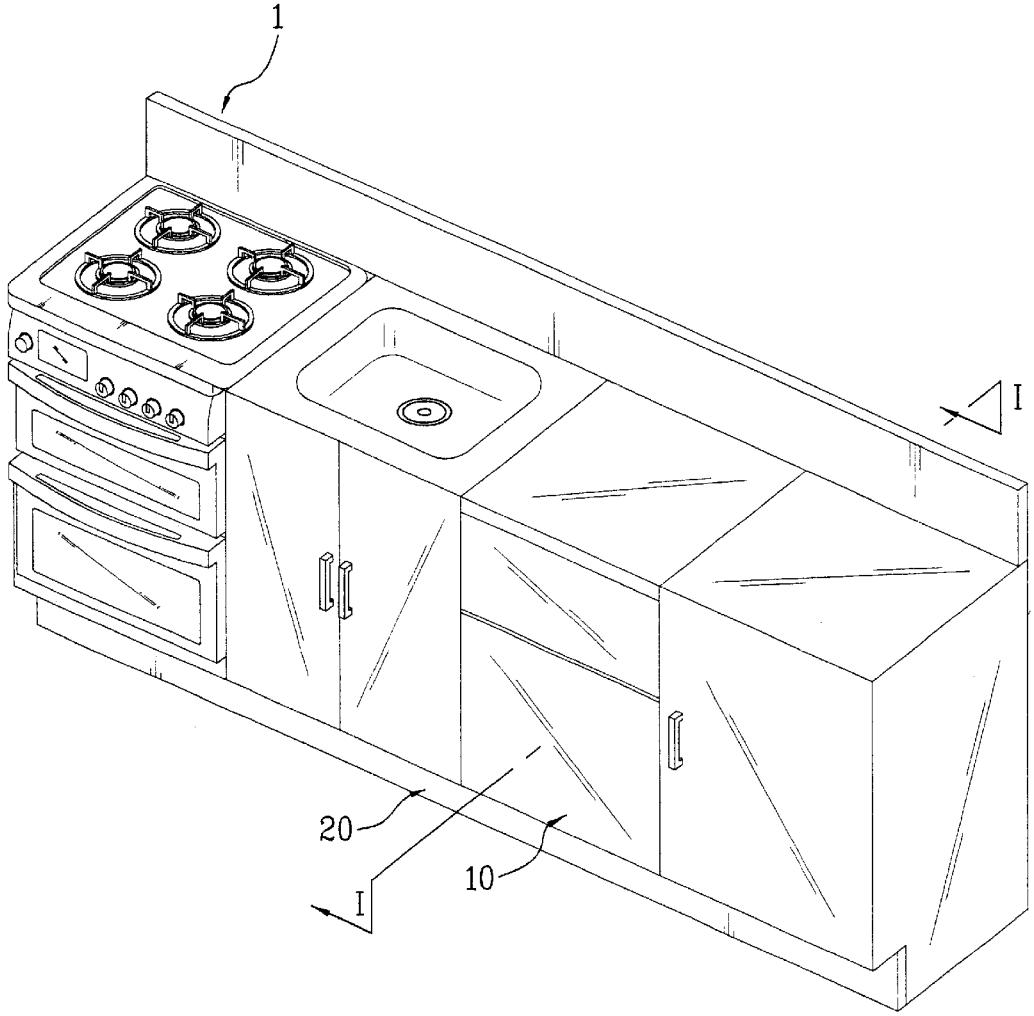
FIG. 1 is a perspective view of a built-in refrigerator installed in a sink according to the present invention.

Reference will now be made in detail to the preferred embodiments of the present invention, examples of which are illustrated in the accompanying drawings. Wherever possible, the same reference numbers will be used throughout the drawings to refer to the same or like parts.

As shown in FIGS. 1 to 4B, a built-in refrigerator according to one embodiment of the present invention includes a main body 10, a condenser 30, a compressor 40, a cooling fan 50 and a radiation passage 60.

Herein, a door 12 is installed at the front of the main body 10, and a machine room 11 is formed at a rear lower side of the main body 10. The condenser 30 and the compressor 40 are installed within the machine room 11, and are preferably installed at both sides of the machine room 11. The cooling fan 50 for cooling the condenser 30 and the compressor 40 is also installed within the machine room 11, and is preferably one pair installed at the center of the machine room 11 to face with the condenser 30 and the compressor 40 respectively. Also, the radiation passage 60 is formed to allow an outside of the front side of the main body 10 to communicate with the machine room 11, and to thus introduce external air into the machine room 11 and discharge internal air of the machine room 11.

Figure 2:
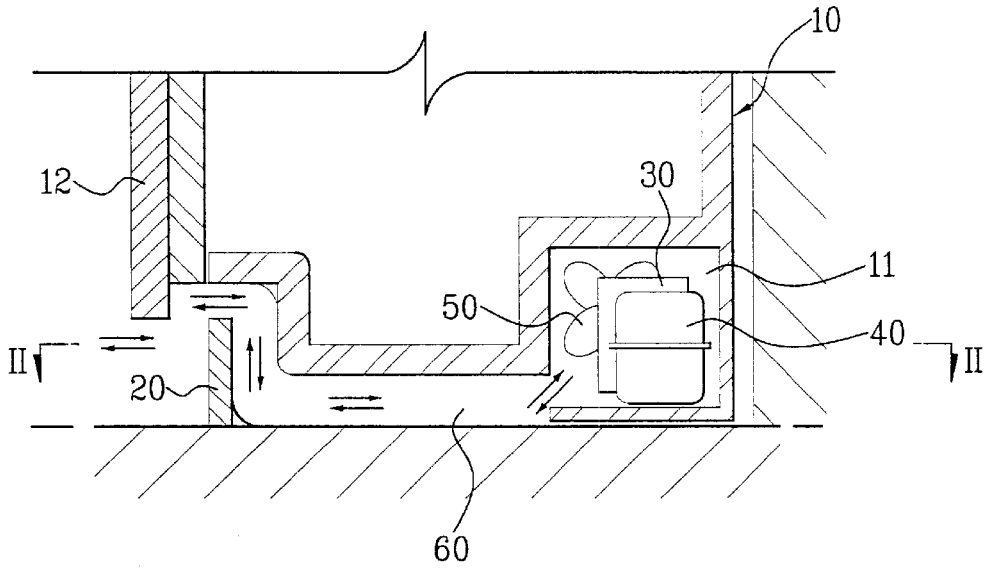
FIG. 2 is a sectional view taken along the line I—I of FIG. 1 and illustrates the radiation passage of the built-in refrigerator.

Meanwhile, the radiation passage 60, as shown in FIG. 2, secures a spacing between the lower side of the main body 10 and the bottom of the indoor room, so that preferably one side of the radiation passage. 60 communicates with the outside of the front side of the main body 10 and the other side communicates with the machine room 11.

Figure 4A:
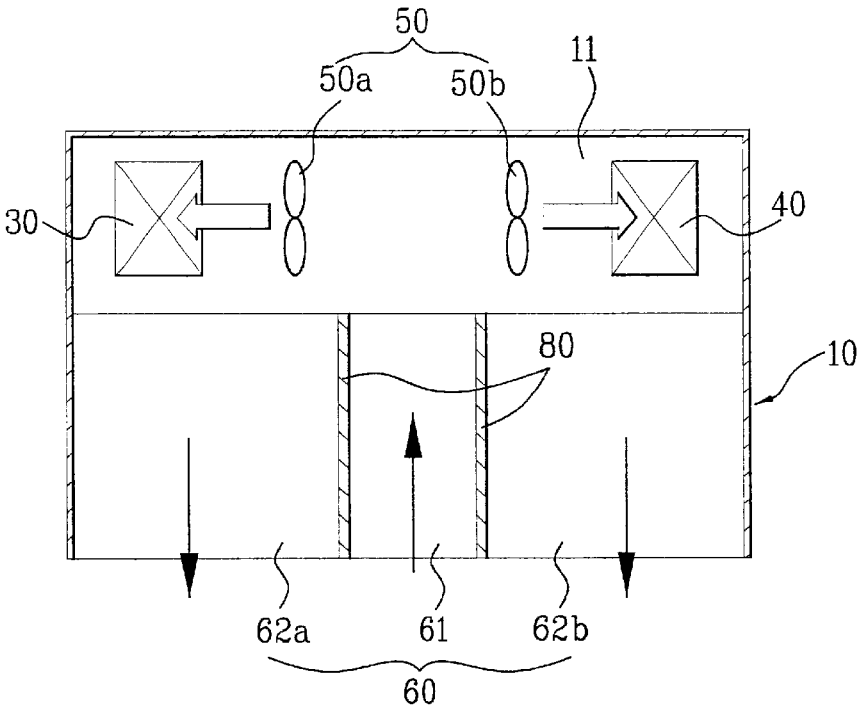
FIG. 4A is a sectional view taken along the line II—II of FIG. 2 according to one embodiment of the present invention.
Figure 4B:
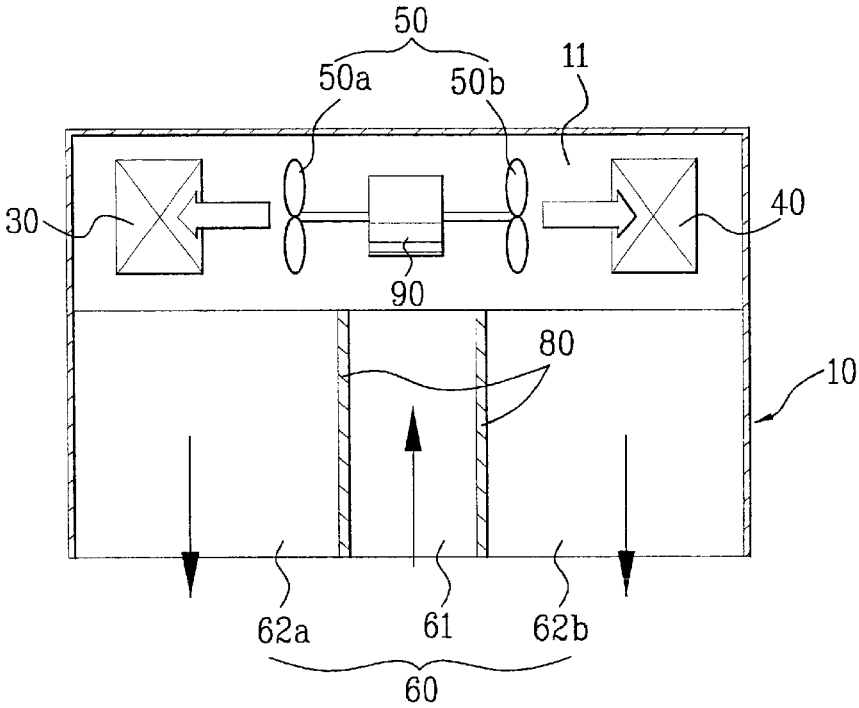
FIG. 4B is a sectional view taken along the line II—II of FIG. 2 according to another embodiment of the present invention.

In addition, as shown in FIGS. 4A and 4B, a dividing strip 80 for dividing the radiation passage 60 into an inflow passage 61 and an outflow passage 62 is preferably installed on the radiation passage 60 such that cool air introduced through the radiation passage 60 is not mixed with hot air of the machine room 11 discharged through the radiation passage 60.

Here, the dividing strip 80 is preferably formed such that the inflow passage 61 is located at the center of the radiation passage 60 and the outflow passage 62 is located at both sides of the inflow passage 61, respectively. Further, the dividing strip, as shown in FIGS. 4A and 4B, is more preferably installed such that the inflow passage 61 is located between introducing sides (where external air is introduced) of the cooling fans 50*a* and 50*b* and the outflow passages 62*a* and 62*b* are respectively located at discharging sides (Where external air is discharged) of the cooling fans 50*a* and 50*b*.

Figure 3:
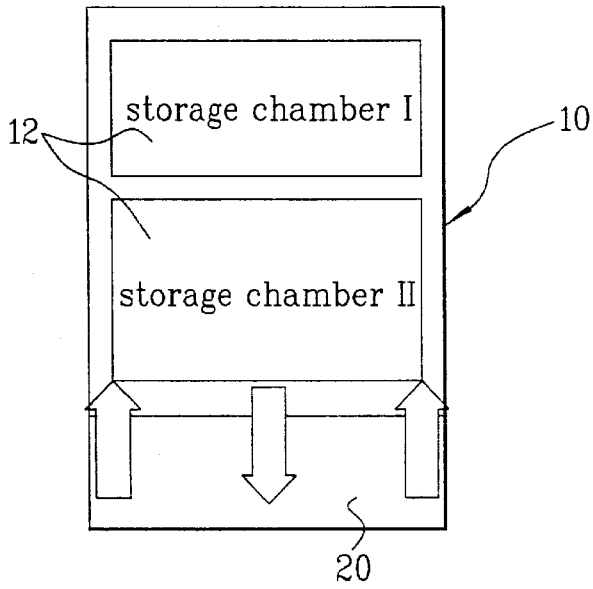
FIG. 3 is a front view of a built-in refrigerator according to the present invention.

Also, in the present invention, the outflow passages 62*a* and 62*b* of the radiation passage 60 are preferably formed extending to the lower side of the periphery of the door 12 of the main body 10. This is to allow natural convective heat to effectively evaporate and eliminate water condensed at both peripheries of the door 12 of the main body 10 while hot internal air is discharged into the outside as shown in FIG. 3.

Meanwhile, in the present invention, the cooling fans 50*a* and 50*b* may be respectively axially coupled to different motors (not shown) as shown in FIG. 4A, or may be respectively axially coupled to both axes of a single motor 90 as shown in FIG. 4B.

Here, a cooling fan system in accordance with one embodiment of the present invention is described with reference to FIG. 4A.

If the respective cooling fans 50*a* and 50*b* are axially coupled to different motors, it becomes possible to drive the respective cooling fans 50*a* and 50*b* at different RPMs, thereby more effectively cooling the compressor 40 and the condenser 30. In other words, upon considering that the heating temperature of the compressor 40 is greater than that of the condenser 30, it becomes possible to drive the second cooling fan 50*b* provided toward the compressor 40 at an RPM higher than the first cooling fan 50*a* provided toward the condenser 30, so that the driving method in which the cooling fans 50*a* and 50*b* are driven at different RFMs allows the efficiency of the apparatus to be enhanced more highly than the driving method in which the cooling fans 50*a* and 50*b* are driven at the same RPM.

Referring to FIGS. 3 and 4B, a cooling fan system according to another embodiment of the present invention is concretely described.

In case the respective cooling fans 50*a* and 50*b* are axially coupled to both sides of the single motor 90, costs for the elements of the refrigerator are saved, and as shown in FIG. 3, since hot internal air is naturally circulated while uniformly discharged through the outflow passages 62*a* and 62*b*, the condensed water forming on the periphery of the door 12 can be more effectively eliminated.

Also, since the adiabatic loads of the left and right sides of the door 12 are symmetric with each other, it becomes possible to maintain the temperature distributions of the left and right sides of the refrigerator at a uniform state.

Meanwhile, on the bottom of the indoor room located at the front lower side of the main body 10 is preferably further installed a floorcloth stay 20. Here, why the floorcloth stay 20 is selected as one of the elements of the refrigerator is to shield a complicated space located at the lower side of the sink 1 considering its appearance, which is a peculiar role of the floorcloth stay 20, and to prevent peripheral garbage during its cleaning from being introduced into the lower space of the sink 1. Thus, for the refrigerator to meet the peculiar role of the floorcloth stay 20 and to have the aforementioned radiation structure, as shown in FIG. 2, there is preferably secured a predetermined spacing between the upper side of the floorcloth stay 20 and the lower side of the main body 10 to form a part of the radiation passage 60. Also, the floorcloth stay 20, as shown in FIG. 1, is preferably formed integrally to be connected with floorcloth stay line of other portion of the sink 1, which is to enhance appearance beauty of the refrigerator.

Hereinbelow, there will be apparent concrete features and advantages of the present invention by reviewing air flow in more detail upon radiation process of the machine room 11 of the built-in refrigerator according to the present invention with reference to FIGS. 4A and 4B.

First, as the first and second cooling fans 50*a* and 50*b* equipped in the machine room 11 are driven, cool external air is introduced into the machine room 11 along the inflow passage 61 located at the center of the radiation passage 60.

The cool external air introduced into the machine room 11 through the inflow passage 61 is blown to the condenser 30 located between the first cooling fan 50*a* and the first outflow passage 62*a* and the compressor 40 located between the second cooling fan 50*b* and the second outflow passage 62*b* while being discharged by the first and second cooling fans 50*a* and 50*b*.

Then, the condenser 30 and the compressor 40 radiate heat with being continuously supplied with the cool external air, and the hot internal air of the machine room 11 heated by the heat radiated from the condenser 30 and the compressor 40 is discharged to the outside through the first and second outflow passages 62*a* and 62*b* located at both sides of the radiation passage 60.

Then, the hot internal air discharged through the first and second outflow passages 62*a* and 62*b*, as shown in FIG. 3, is elevated by natural convection, thereby evaporating and eliminating condensed water forming on the periphery of the door 12. Thus, the built-in refrigerator of the present invention does not need to install a separate hot line for eliminating the condensed water forming on the periphery of the door.

As described previously, the built-in refrigerator of the present invention provides the following useful effects.

First, it becomes possible to effectively radiate the condenser and the compressor provided in the machine room 11 of the refrigerator.

Secondly, since the superior radiation performance of he machine room allows the refrigerator to be installed at the sink, practical space use of the kitchen or the living room is enhanced and beauty on appearance becomes better.

Thirdly, since the heat discharged from the machine room evaporates the condensed water forming on the periphery of the door during natural convection thereof, there is no need of installation of hot line for eliminating the condensed water, so that production costs of the refrigerator are saved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A built-in refrigerator, comprising;

a main body installed adjacent to a sink and having a door at a front side thereof and a machine room at a rear lower side thereof;

a condenser and a compressor respectively installed in the machine room;

a cooling fan installed in the machine room, for cooling the condenser and the compressor; and a radiation passage configured to allow external air from a front side of the main body into the machine room and to discharge air from the machine room to the front side of the main body.

2. The built-in refrigerator of claim 1, wherein the condenser and the compressor are respectively installed at both sides of the machine room.

3. The built-in refrigerator of claim 2, wherein the cooling fan comprises a pair of cooling fans installed at a center of the machine room so as to face each other.

4. The built-in refrigerator of claim 1, wherein the radiation passage is formed by securing a spacing between a lower side of the main body and a surface on which the refrigerator is disposed.

5. The built-in refrigerator of claim 4, further comprising a dividing strip which divides the radiation passage into an inflow passage through which external air is introduced and an outflow passage through which internal air is discharged.

6. The built-in refrigerator of claim 5, wherein the dividing strip is installed such that the inflow passage is formed at a center of the radiation passage and the outflow passage is formed at both sides of the inflow passage.

7. The built-in refrigerator of claim 6, wherein the dividing strip is installed such that the inflow passage is located between introducing sides of the cooling fan and the outflow passage is located at a discharging side of the cooling fan.

8. The built-in refrigerator of claim 7, wherein the outflow passage is formed extending to a lower side of a periphery of the door of the main body.

9. The built-in refrigerator of claim 3, wherein the respective cooling fans are axially coupled to different motors.

10. The built-in refrigerator of claim 3, wherein the respective cooling fans are axially coupled to both sides of a single motor.

11. The refrigerator of claim 4, further comprising a floorcloth stay configured to be located at a front lower side of the main body on a surface on which the refrigerator is disposed.

12. The refrigerator of claim 1, wherein the radiation passage extends along a lower portion of the main body.

13. The refrigerator of claim 1, wherein the main body is disposed adjacent to a sink between base cabinets.

14. The refrigerator of claim 13, wherein the main body is disposed adjacent to a sink in an opening between base cabinets.

15. A refrigerator, comprising:

a main body installed adjacent to a sink and having a door at a front side thereof and a machine room at a rear lower side thereof;

a condenser and a compressor respectively installed in the machine room;

a cooling fan installed in the machine room, for cooling the condenser and the compressor; and a radiation passage configured to allow external air from a front side of the main body into the machine room and to discharge air from the machine room to the front side of the main body; and a floorcloth stay configured to be located at a front lower side of the main body on a surface on which the refrigerator is disposed, wherein a predetermined spacing secured between an upper side of the floorcloth stay and the lower side of the main body forms a part of the radiation passage.

16. The refrigerator of claim 15, wherein the floorcloth stay is formed integrally to be connected with a floorcloth stay of other portion of the sink.

17. A built-in refrigerator, comprising:

a main body installed near a sink and having a door at a front side thereof and a machine room at a rear lower side thereof;

a condenser and a compressor respectively installed in the machine room;

a pair of cooling fans installed in the machine room to face the condenser and the compressor, respectively, for cooling the condenser and the compressor; and a radiation passage configured to allow external air from a front side of the main body into the machine room and to discharge air from the machine room to the front side of the main body.

18. A refrigerator, comprising:

a main body installed adjacent to a sink and having a door at a front side thereof and a machine room at a rear lower side thereof;

condenser and compressor respectively installed in the machine room; a cooling fan installed in the machine room, for cooling the condenser and the compressor;

a radiation passage configured to allow external air from a front side of the main body into the machine room and to discharge air from the machine room to the front side of the main body; and a dividing strip for dividing the radiation passage into an inflow passage through which the external air is introduced and an outflow passage through which the internal air is discharged.

* * * * *